US007600849B2

(12) United States Patent
Bibl et al.

(10) Patent No.: US 7,600,849 B2
(45) **Date of Patent: *Oct. 13, 2009**

(54) METHOD AND APPARATUS FOR SCALABLE DROPLET EJECTION MANUFACTURING

(75) Inventors: Andreas Bibl, Los Altos, CA (US); Martin Schoeppler, Los Altos, CA (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/140,173

(22) Filed: Jun. 16, 2008

(65) Prior Publication Data

US 2008/0246792 A1 Oct. 9, 2008

Related U.S. Application Data

(63) Continuation of application No. 11/484,975, filed on Jul. 11, 2006, now Pat. No. 7,427,119.

(60) Provisional application No. 60/699,111, filed on Jul. 13, 2005.

(51) Int. Cl.
*B41J 29/393* (2006.01)

(52) U.S. Cl. ..... 347/19; 347/43

(58) Field of Classification Search ..... 347/40, 347/43, 19, 64–65, 12, 15; 358/504; 29/890.1
See application file for complete search history.

(56) References Cited

U.S. PATENT DOCUMENTS

| | | | | |
|---|---|---|---|---|
| 5,606,352 | A * | 2/1997 | Yamakawa et al. | 347/20 |
| 5,781,213 | A * | 7/1998 | Ujita et al. | 347/86 |
| 7,427,119 | B2 * | 9/2008 | Bibl et al. | 347/19 |
| 2005/0126002 | A1 * | 6/2005 | Nakao | 29/890.1 |

* cited by examiner

*Primary Examiner*—Lamson D Nguyen
(74) *Attorney, Agent, or Firm*—Fish & Richardson P.C.

(57) ABSTRACT

A method includes ejecting liquid having a first composition from a first droplet ejection deposition system that includes a first printhead and a first fluid source, collecting information on the behavior of the liquid under a variety of ejection conditions for the first droplet ejection deposition system, and ejecting liquid having the first material composition from a second droplet ejection deposition system that includes a second printhead and a second fluid source under the selected ejection conditions. The first printhead has a small number of flow paths, and the first fluid source is configured to hold a small volume of liquid. The second printhead has a plurality of substantially identical flow paths, each of the flow paths being substantially identical to at least one of the small number of flow paths, and there being a significantly larger number of flow paths in the second printhead than in the first printhead.

20 Claims, 9 Drawing Sheets

METHOD AND APPARATUS FOR SCALABLE DROPLET EJECTION MANUFACTURING

CROSS-REFERENCE TO RELATED APPLICATIONS

This application is a continuation of U.S. application Ser. No. 11/484,975, filed Jul. 11, 2006, which claims priority to U.S. Provisional Application No. 60/699,111, filed Jul. 13, 2005. The disclosure of the prior applications are considered part of (and are incorporated by reference in) the disclosure of this application.

BACKGROUND

This invention relates to manufacturing techniques that use ejection of fluid droplets.

In various industries it is useful to controllably deposit a fluid onto a substrate by ejecting droplets of the fluid from a fluid ejection module. For example, ink jet printing uses a printhead to produce droplets of ink that are deposited on a substrate, such as paper or transparent film, in response to an electronic digital signal, to form an image on the substrate.

An ink jet printer typically includes an ink path from an ink supply to a printhead that includes nozzles from which ink drops are ejected. Ink drop ejection can be controlled by pressurizing ink in the ink path with an actuator, which may be, for example, a piezoelectric deflector, a thermal bubble jet generator, or an electrostatically deflected element. A typical printhead has a line of nozzles with a corresponding array of ink paths and associated actuators, and drop ejection from each nozzle can be independently controlled. In a so-called "drop-on-demand" printhead, each actuator is fired to selectively eject a drop at a specific pixel location of an image, as the printhead and a printing media are moved relative to one another. A high performance printhead may have several hundred nozzles, and the nozzles may have a diameter of 50 microns or less (e.g., 25 microns), may be separated at a pitch of 100-300 nozzles per inch, and may provide drop sizes of approximately 1 to 70 picoliters (pl) or less. Drop ejection frequency is typically 10 kHz or more.

A printhead can include a semiconductor body and a piezoelectric actuator, for example, the printhead described in Hoisington et al., U.S. Pat. No. 5,265,315. The printhead body can be made of silicon, which is etched to define ink chambers. Nozzles can be defined by a separate nozzle plate that is attached to the silicon body. The piezoelectric actuator can have a layer of piezoelectric material that changes geometry, or bends, in response to an applied voltage. The bending of the piezoelectric layer pressurizes ink in a pumping chamber located along the ink path.

SUMMARY

A tremendous variety of fluids with different material compositions are available, and the number of such fluids continues to increase as new materials and compositions are investigated. Often, fluids need to be tested for their effectiveness in a proposed application. For example, the activity of biological compounds may need to be measured to determined the best candidate for a medicine. In addition, due to their different material properties, fluids may react differently under the same droplet ejection conditions. Thus, droplet ejection conditions may need to be individually determined for optimal deposition of a particular fluid. The present invention can enable a scalable technique that permits information learned about a fluid during small-scale testing to be applied effectively when transitioning to use of the fluid in large scale, e.g., commercial or high volume, droplet-ejection conditions.

In general, in one aspect the invention describes a method that includes ejecting liquid having a first composition from a first droplet ejection deposition system that includes a first printhead and a first fluid source, collecting information on the behavior of the liquid under a variety of ejection conditions for the first droplet ejection deposition system, and ejecting liquid having the first material composition from a second droplet ejection deposition system that includes a second printhead and a second fluid source under the selected ejection conditions.

The first printhead has a small number of flow paths, and the first fluid source is configured to hold a first volume of liquid. The second printhead has a plurality of substantially identical flow paths, each of the flow paths being substantially identical to at least one of the small number of flow paths, and there being a significantly larger number of flow paths in the second printhead than in the first printhead. The second fluid source is not self-contained or is configured to hold a second volume of liquid larger than the first volume.

Implementations of the invention may include one or more of the following features. The small number may be at most ten, e.g., one. There may be at least ten times as many, e.g., one-hundred times as many, fluid paths in the second printhead than in the first printhead. Each first fluid path and second fluid path may include a nozzle and an inlet, and the first printhead and the second printhead may include an actuator for each flow path. Selecting ejection conditions may include determining ejection conditions that are at least satisfactory for droplet ejection from the first droplet ejection deposition system or from the second droplet ejection deposition system. The second printhead may be designed based on the information. A fluid supply unit may be joined to a printhead unit for form a cartridge that is removably installable in the first droplet ejection deposition system. The liquid may be delivered to the fluid supply unit. The fluid supply unit and the printhead unit may be substantially not detachable once joined. The cartridge may be disposable, whereas the second printhead may be reusable. The fluid supply unit may be self-contained, whereas the second fluid source may not be self-contained. A plurality of liquids having different compositions may be ejected from the first droplet ejection deposition system. The plurality of liquids may be tested for effectiveness in a proposed application, and the first composition may be selected from the different compositions based on effectiveness. Information on the behavior of the plurality of liquids may be collected, and the first composition may be selected from the different compositions based on suitability for droplet ejection.

The invention can be implemented to realize one or more of the following advantages. Fluids may be tested using a droplet ejection systems suitable for small volumes of liquid, permitting valuable test liquids to be conserved, and thus reducing the costs of testing. Since the fluid flow-path configuration is similar or identical in the small-scale and large-scale droplet ejection modules, the fluid should react similarly under a given set of droplet ejection conditions. Thus, information learned about a fluid during small-scale testing may be applied effectively when transitioning to use of the fluid in large-scale, e.g., commercial or high volume, droplet-ejection conditions. Large-scale droplet ejection modules may be designed with fewer (or even no) testing iterations, and testing time to determine other droplet ejection conditions can be dramatically reduced. As a result, the time from identification of a suitable fluid to commercialization of use of that fluid may be significantly reduced. Overall, the invention may enable manufacturers to enter the market with applications that use droplet ejection more quickly and at lower research and development cost.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

Like reference symbols in the various drawings indicate like elements.

DETAILED DESCRIPTION

As discussed above, a tremendous variety of liquids with different material compositions are available, and the number of such liquids continues to increase as new materials and compositions are investigated. Liquids may need to be tested for their effectiveness in a proposed application, and droplet ejection conditions may need to be individually determined for optimal deposition of a particular liquid.

A typical liquid that may need to be tested is ink, and for illustrative purposes, the techniques and droplet ejection modules are described below in reference to a printhead module that uses ink as the liquid. However, it should be understood that other liquids can be used, such as electroluminescent or liquid crystal material used in the manufacture of displays, metal, semiconductor or organic materials used in circuit fabrication, e.g., integrated circuit or circuit board fabrication, and organic or biological materials, e.g., for drugs or the like.

Figure 1:
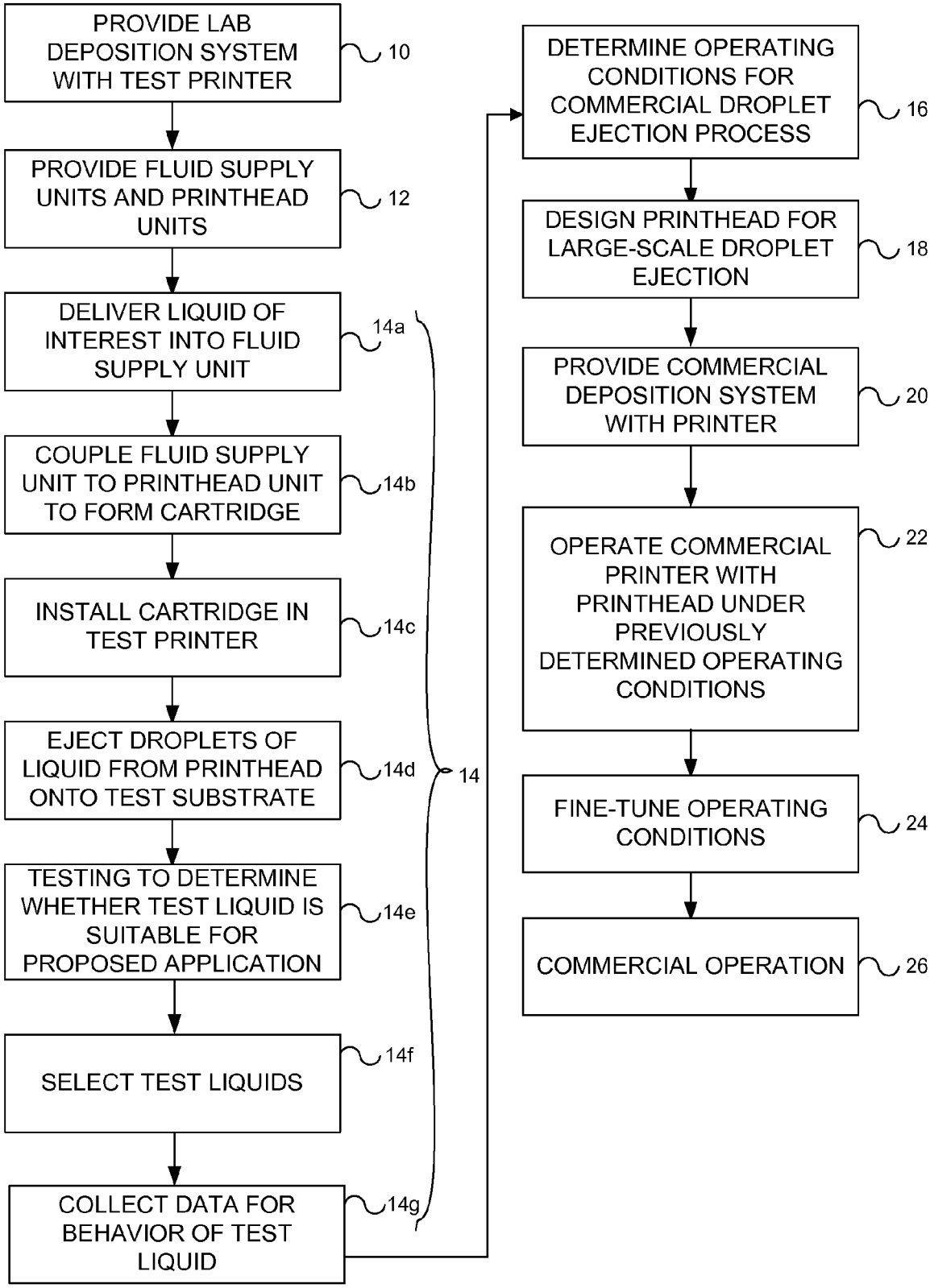
FIG. 1 is a flow chart illustrating a method for bringing a droplet ejection technology to market.
Figure 2:
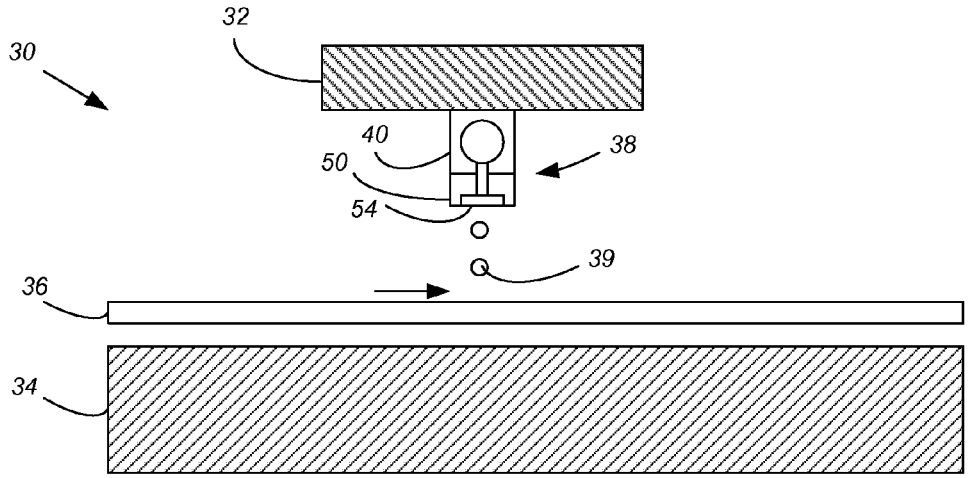
FIG. 2 is a schematic diagram of a printer for small-scale droplet ejection printing of test liquids.

Referring to FIG. 1, initially, a lab deposition system is provided (step 10). The lab deposition system includes a test printer. Referring to FIG. 2, a test printer 30 includes a platform 32 onto which one or more print cartridges 38 can be detachably secured. Each cartridge includes a fluid supply unit 40 and a printhead unit 50. The test printer 30 also includes a support 34 to hold a substrate 36 that will receive the drops of ink 39 from a printhead in the cartridge, and a mechanism to provide relative motion between the cartridge 38 and the substrate 36. The test printer 30 will also include an interface that will electronically couple electrical contacts on the cartridge to a drive system, such as a programmable digital computer. The test printer can also include a pressure control line that can be fluidly coupled to the cartridge to provide a controllable negative pressure to control a meniscus in the printhead in the cartridge. However, the test printer 30 does not include any separate ink source or connection for coupling to an ink source; the ink supply is expected to be contained within the cartridge that will be secured to the platform 32.

A suitable test printer is described in co-owned U.S. Provisional Patent Application Ser. No. 60/699,436, filed Jul. 13, 2005, the entire disclosure of which is incorporated by reference. In this implementation, platform 32 is movable along an X axis, and the support 34 is rotatable about the Z axis and movable along the Y axis. However, in other implementations the support 34 could be generally immobile or be only rotatable, and the platform 32 could be movable along both X and Y axes. Alternatively, the platform 32 could be generally immobile, and the support could be rotatable and movable along both the X and Y axes.

The lab deposition system may include other components, such as substrate handling system for fragile substrates, a curing system to cure the deposited liquid, or a sealed environment to prevent contamination of the substrate or to prevent release of hazardous compounds from the deposition liquid. A lab deposition system is described in co-owned U.S. Provisional Patent Application Ser. No. 60/699,437, filed Jul. 13, 2005, the entire disclosure of which is incorporated by reference.

Returning to FIG. 1, in addition to the lab deposition system, a plurality of fluid supply units and a plurality of printhead units are provided (step 12). The fluid supply units and printhead units could be provided before or after (or both) the lab deposition system. In particular, the fluid supply units and printhead units can be provided in kits, e.g., 50 or 100 of each type of unit.

Figure 3A:
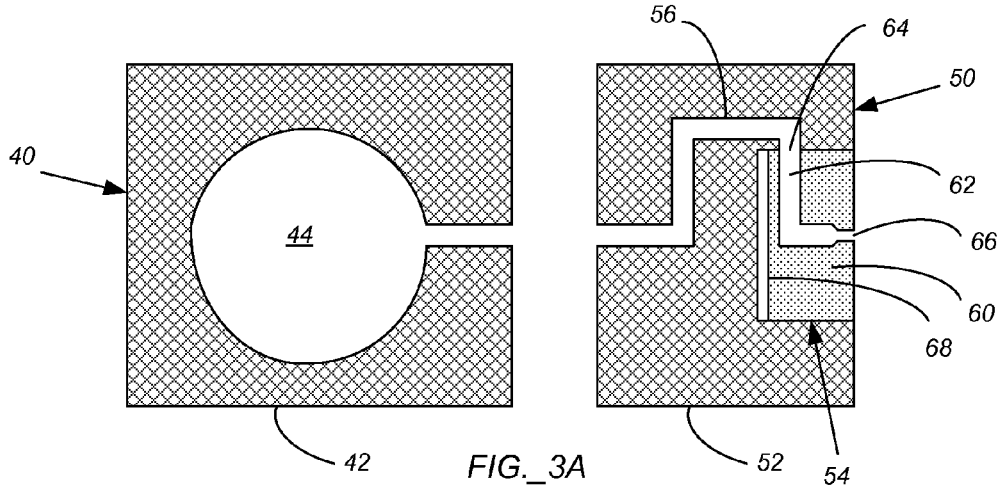
FIG. 3A is a schematic diagram of a fluid supply unit and a printhead unit.
Figure 3B:
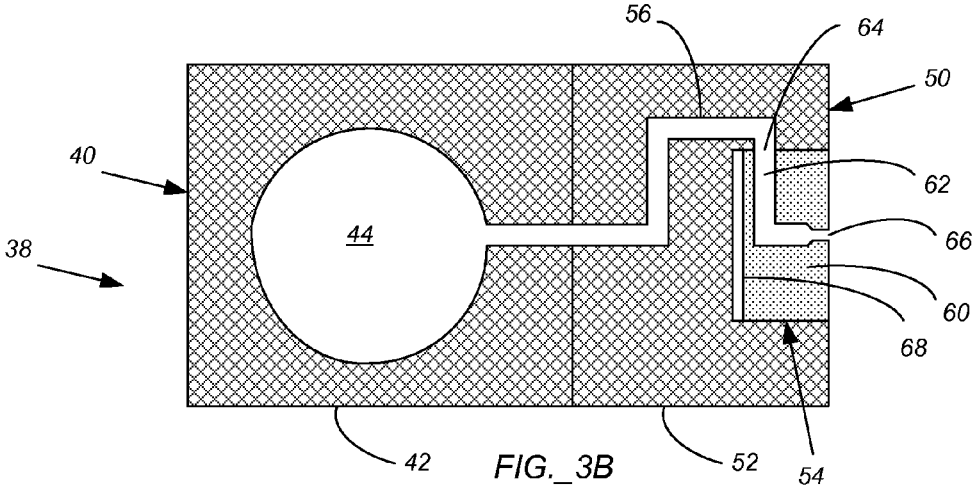
FIG. 3B is a schematic diagram of the fluid supply unit and printhead unit of FIG. 3A joined to form a cartridge for use in the printer of FIG. 2.

Referring to FIG. 3A, a fluid supply unit 40 includes a fluid supply housing 42 and a reservoir 44, whereas a printhead unit 50 includes a printhead housing 52 that supports a printhead 54. Referring to FIGS. 3A and 3B, the fluid supply unit 40 and the printhead unit 50 can be joined to form the cartridge 38 that can be removably installed on the platform. Although the cartridge 38 is removable from the platform, the fluid supply unit 40 and printhead unit 50 are generally not detachable from each other once joined, e.g., not detachable without physically breaking components of the cartridge. For example, in one implementation the fluid supply housing 42 and printhead housing 52 can have a snap-fit mechanism. Moreover, the printhead unit 50 can be implemented such that once the fluid supply unit 40 is attached, the printhead unit 50 cannot be purged The fluid supply unit 40 is configured for limited liquid volumes. For example, the reservoir 44 can be a container with a small discrete volume, e.g., less than 2.0 ml, such as 1.5 ml, suitable for either expensive materials or for applications where only a small volume are applied. In addition, the fluid supply unit 40 can be self-contained, i.e., no liquid will be added once the fluid supply unit 40 is combined with the printhead unit 50 to form the cartridge. Alternatively, the fluid-supply unit 40 can be configured such that liquid can be added once the cartridge is assembled, but not while the cartridge is installed in the test printer. In one implementation, the reservoir 44 can be a flexible container, e.g., a bag or pouch.

The printhead 54 in the printhead unit 50 is a body, e.g., a chip or die, that includes a microelectromechanical system (MEMS) for droplet ejection. In particular, the printhead 54 can include a silicon body 60 through which one or more fluid paths 62 are formed from an inlet 64 to a nozzle 66. In addition, the printhead 54 can include an actuator 68, e.g., a piezoelectric actuator, associated with each fluid path 62 to produce a pressure pulse to controllably eject the ink drops from the corresponding nozzle 66 in the body. A passage 56 through the printhead housing 52 can supply the liquid from the fluid-supply unit 40 to the printhead 54.

The printhead 54 can be fabricated primarily using semiconductor-industry processing techniques to have precisely formed features such that each printhead has a substantially identical flow path, material characteristics, and responsiveness to control signals. In general, the printhead 54 is configured for small-scale operations. In particular, the printhead 54 includes a limited number nozzles 66, for example, ten or fewer nozzles, e.g., just one nozzle, from which ink drops are ejected.

The cartridge, typically the printhead housing 52, also includes electrical contacts that will couple to the interface on the platform of the test printer. The electrical contacts are connected, e.g., by a flex circuit, to the printhead 54 to provide the control signals from the drive system. The cartridge, e.g., the printhead housing 52, can support signal processing circuitry, e.g., a microprocessor or application-specific integrated circuit (ASIC), to convert the control signals from the drive system into a form, e.g., drive pulses, more suitable for the printhead 54. In addition, the cartridge can include a passage that can be fluidly coupled to the pressure control line on the platform to provide a negative pressure to control a meniscus in the printhead.

In general, the cartridge 38 can be considered disposable; the cost of a new cartridge can be comparable or less than the cost of cleaning an old cartridge to receive a new test liquid. Thus, typically over the life of the cartridge, a test fluid would be placed in the reservoir just once, the fluid supply unit 40 would be secured to the printhead unit 50 to form the cartridge 38, the cartridge would be used until the test liquid is determined to no longer be of interest or the reservoir is substantially exhausted, and the cartridge would then be discarded. Of course, the cartridge could be interchanged with other cartridges to test other liquids on the same printer, and could be used multiple times on the same or different printers, before the determination to discard the cartridge. Furthermore, because both the fluid supply and the printhead are part of a disposable unit, the printer does not include interior components, such as ink supply passages, which would need to be cleaned between testing of different liquids (it may still be advantageous to clean the exterior of the printer after use to remove the test fluid, e.g., if deposited by splash-back, to prevent contamination).

A fluid supply unit 40 and a printhead unit 50 that can be joined to form a cartridge are described in U.S. Patent Application Ser. No. 60/637,254, filed Dec. 17, 2004, and in U.S. Patent Application Ser. No. 60/699,134, filed Jul. 13, 2005, and in U.S. patent application Ser. No. 11/305,824, filed Dec. 16, 2005 (in each of which the cartridge is referred to as a printhead module), the entire disclosures of which are incorporated by reference.

Figure 4A:
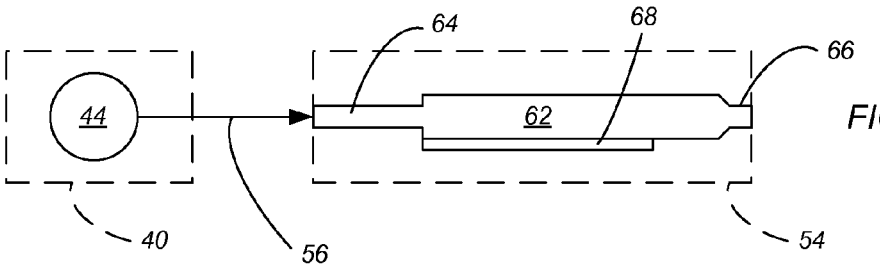
FIGS. 4A-4C are schematic diagrams of fluid paths in three implementations of a small-scale printing system.
Figure 4B:
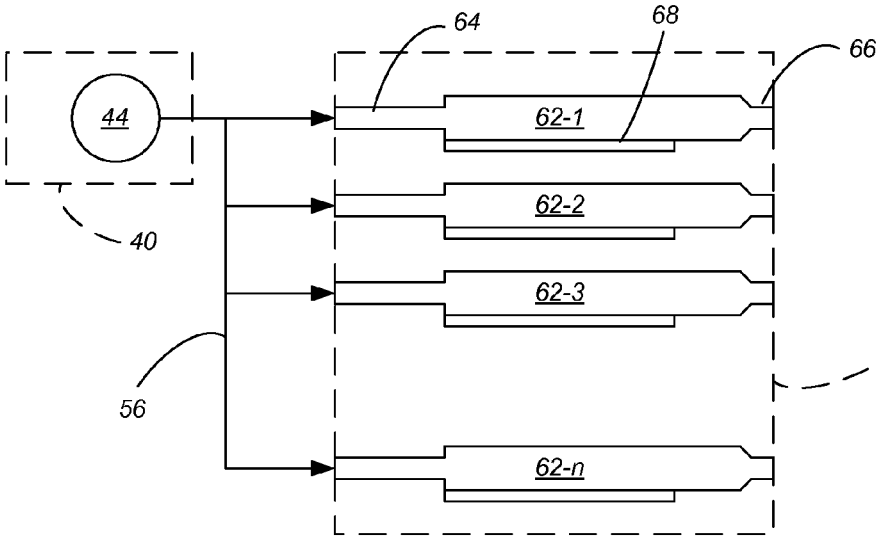
Figure 4C:
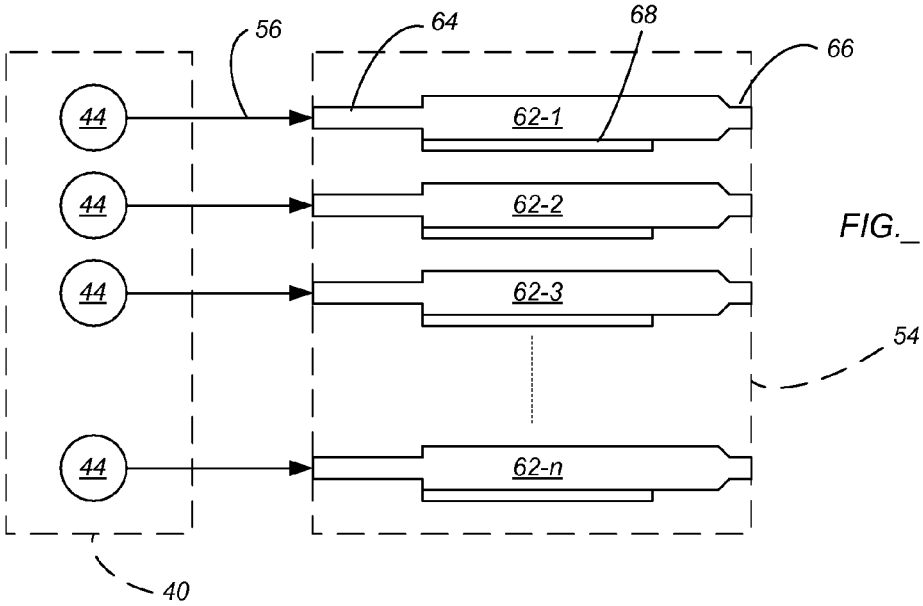

FIGS. 4A-4C schematically illustrate three implementations of fluid flow paths in the cartridge. In the implementation illustrated in FIG. 4A, the printhead 54 can include a single flow path 62 with a single nozzle 66, and the fluid supply unit can include a single reservoir 44.

In the implementation illustrated in FIG. 4B, the printhead includes multiple flow paths 62-1, 62-2, . . . , 62-n, e.g., ten or fewer flow paths, with each flow path including a nozzle 66 fluidly coupled in common to the same reservoir 44 in the fluid supply unit 40. Although the system is illustrated with the passage 56 in the housing branching to separate inlets for each flow path 62, the printhead 54 could have a single common inlet and the branching could occur within the silicon body 60. The flow paths 62-1, 62-2, . . . , 62-n can be identical in structure, or the flow paths can be different, for example, have a different physical dimension of the nozzle or pumping chamber, or have different material characteristics, e.g., a non-wetting coating could be present on one flow path but not other flow paths. The use of different flow paths may be advantageous in simultaneously testing multiple flow path structures to determine the flow path structure that is best suited for droplet ejection of the particular test liquid.

In the implementation illustrated in FIG. 4C, the printhead includes multiple flow paths 62-1, 62-2, . . . , 62-n, e.g., ten or fewer flow paths, with each flow path having a nozzle 66 fluidly coupled to an associated reservoir 44 in the fluid supply unit 40. Each reservoir 44 can contain a different test liquid. This may be advantageous in simultaneously testing multiple test liquids under identical ejection conditions.

Returning to FIG. 1, one or more liquids undergo testing using the lab deposition system (step 14). In particular, as part of the testing procedure, each test liquid of interest can be delivered into a fluid supply unit (step 14*a*). The fluid supply unit is then coupled to printhead unit to form a cartridge (step 14*b*), and the cartridge is removably installed in the test printer (step 14*c*). The test liquid can then be ejected as droplets by the printhead onto a test substrate (step 14*d*).

Optionally, as part of the testing procedure, a test liquid that has been deposited on a substrate can be tested for its effectiveness in a proposed application (step 14*e*). For example, the activity of biological compounds may need to be measured to determined the best candidate for a medicine. As another example, the conductivity of a metallic, semiconductive or insulative material may need to be measured to determine the best candidate for a conductor or dielectric layer in a circuit. As another example, the opacity of an organic or inorganic material may need to be measured to determine the best candidate for a masking material. Based on the testing procedure, test liquids that satisfy the criteria for effectiveness can be selected for further investigation or for use (step 14*f*).

For at least the liquids that are selected for use, data is collected on the behavior of the test liquid under the ejection conditions (step 14*g*). Using the data collected during the testing procedure, ejection conditions that are at least satisfactory for commercial or large-scale droplet ejection deposition of the liquid are determined (step 16). In practice, this may mean ejecting the test liquid under a variety of ejection conditions until conditions that provide satisfactory droplet behavior in the test system are identified.

Parameters that can be measured during the small-scale testing to determine the suitability of the ejection conditions for large-scale droplet ejection can include droplet characteristics, e.g., the presence of well-defined droplets or the absence of tails or satellite drops, and the drop volume, drop velocity, or drop frequency of the droplets, as well as droplet behavior on the substrate, e.g., degree of splash-back, adhesion of the droplet to the substrate, wettability or spread of the droplet across the substrate. Parameters of the ejection conditions that can be varied during testing (e.g., by subjecting the printhead to sequentially different conditions) can include drive pulse shape, amplitude and frequency, standoff height of the printhead from the substrate, and the temperature of the ink, substrate and environment. Parameters of the flow path that can be tested (e.g., by using multiple cartridges simultaneously or sequentially with different printheads, or by using a cartridge with multiple flow paths with different characteristics), include flow path dimensions, e.g., the dimensions of nozzle, pumping chamber, and connecting passages. Parameters of the liquid that can be varied during testing (e.g., by using multiple cartridges simultaneously or sequentially with different test liquids, or by using a cartridge with multiple flow paths connected to different reservoirs with different liquids) include composition, including resulting characteristics such as viscosity, surface tension, and density.

A printhead unit suitable for large-scale droplet ejection can be designed based on the information collected during the testing step (step 18). In particular, this printhead unit can include a printhead with a plurality of flow paths that are substantially identical to the flow path in the test printhead.

Figure 5:
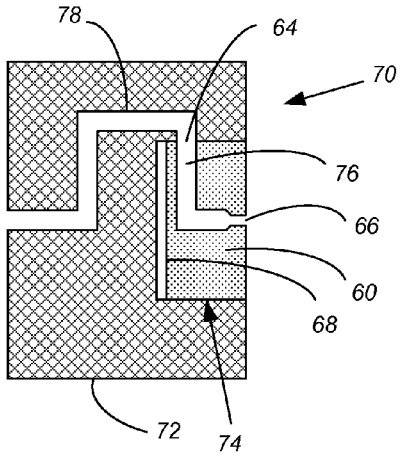
FIG. 5 is a schematic diagram of a printhead unit for a scaled-up printing system.
Figure 6:
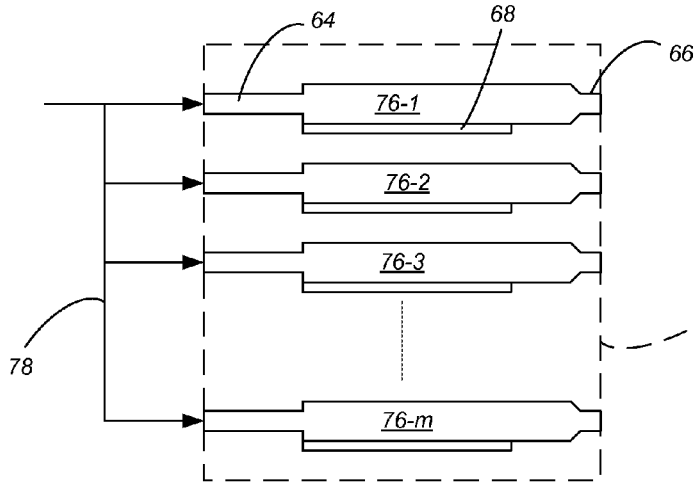
FIG. 6 is a schematic diagram of a fluid path in a scaled-up printing system.

Referring to FIGS. 5 and 6, the printhead unit 70 for commercial applications includes a printhead housing 72 that supports a printhead 74. The printhead 74 includes a large number of flow paths 76, e.g., several dozen or several hundred flow paths 76. Typically, the printhead 74 would have at least ten times as many flow paths 76 as the test printhead 54. Each flow path 76 is substantially identical in structure, with an inlet 64, a nozzle 66, and an actuator 68, e.g., a piezoelectric actuator, to produce a pressure pulse to controllably eject an ink drops from the corresponding nozzle 66. Each flow path 76 can be substantially identical to the selected flow path 62 from the test printhead 54. Each nozzle is fluidly coupled to a common passage 78 in the printhead housing 72 (and thus to the same fluid supply). Again, although the system is illustrated with the passage 78 in the housing 72 branching to separate inlets for each flow path 76, the printhead 74 could have a single common inlet and the branching could occur within the silicon body 60.

Returning to FIG. 1, a commercial droplet ejection deposition system is provided with a commercial printer (step 20). The printhead unit can then be used in the commercial printer under the previously determined operating conditions (step 22). Optionally, additional testing can be performed to fine-tune the operating conditions (step 24). However, since the flow-path configuration in the print module and liquid composition are identical to the testing condition, only minimal modification of the operating conditions should be needed. Once any fine-tuning has been performed, the system should be ready for commercial operation (step 26).

If the commercial droplet ejection process also only uses limited liquid volumes, then the commercial configuration can be similar to the test configuration, e.g., the fluid supply unit and the printhead unit can be combined form a disposable cartridge that is removably installable in a platform on the printer, the reservoir can be a container with a small volume, and the fluid supply unit can be self-contained. Of course, as noted above, the commercial configuration will differ in that the commercial printhead includes many more flow paths and nozzles than the test printhead, and the architecture of the printer to provide relative motion between the printhead and the substrate can be different as well. In addition, the fluid supply unit in the commercial droplet ejection deposition system can be configured to hold a larger volume of fluid than the fluid supply unit in the lab deposition system.

Alternatively, the fluid supply unit for the commercial system can be self-contained and the reservoir can be a container with a small volume, but the printhead unit can be mounted on the printer platform as a reusable unit (rather than being a disposable part of the cartridge). In this case, the fluid supply unit can be detachably secured to the printhead unit.

Figure 7:
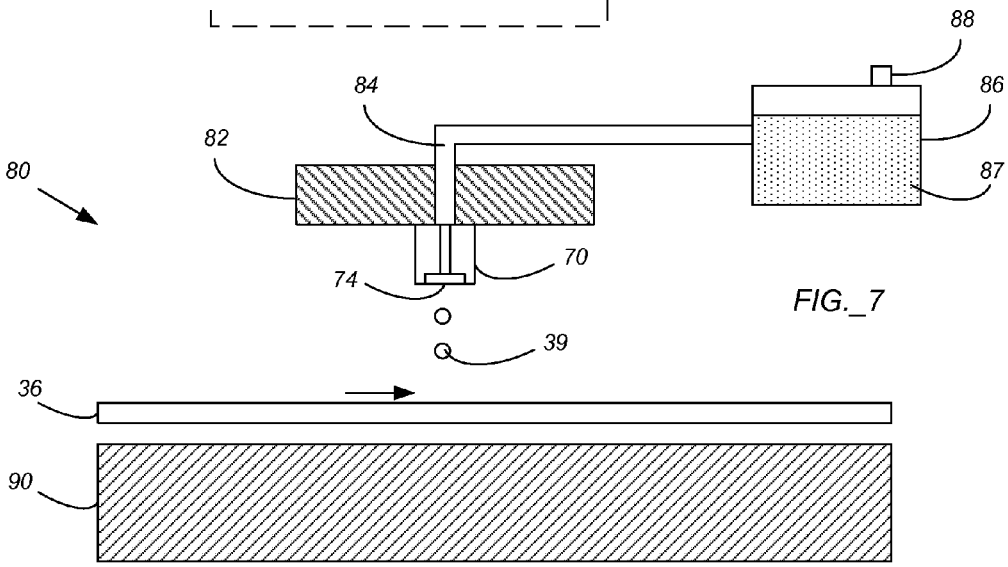
FIG. 7 is a schematic diagram of a printer for scaled up droplet ejection printing.

However, the commercial droplet ejection process might use large liquid volumes. In this case, referring to FIG. 7, a commercial printer 80 can includes a platform 82 onto which one or more printhead units 70 are mounted, and fluid lines 84 for fluidly coupling the printhead units 70 to a separate fluid source 86 that contains the liquid 87, e.g., ink. The fluid source 86 can be open, i.e., it is possible to add liquid to the source 86, e.g., through a port 88. In fact, it can be possible to add liquid to the source while the source 86 remains coupled to the printhead unit 70, e.g., either between printing operations or during printing. In this implementation, the printhead unit is not disposable; the printhead is likely to be cleaned and reused if the fluid source is exhausted, or if a new liquid is to be droplet ejected.

The commercial printer 30 can also include a support 90 to hold a substrate 36 that will receive the drops 39 of ink from the printhead 74, and a mechanism to provide relative motion between the printhead 74 and the substrate 36. The printer 80 will also include an interface that will electronically couple electrical contacts on the printhead unit to a drive system, such as a programmable digital computer. The printer can also include a pressure control line that can be fluidly coupled to the printhead unit to provide a controllable negative pressure to control a meniscus in the printhead in the cartridge.

An exemplary printhead unit is described in co-owned U.S. patent application Ser. No. 11/119,308, filed Apr. 28, 2005, the entire disclosure of which is incorporated by reference. An exemplary mounting system for holding a printhead unit in a printer and supplying ink to the printhead is described in co-owned U.S. patent application Ser. No. 11/117,146, filed Apr. 27, 2005, the entire disclosure of which is incorporated by reference.

The present invention can enable a scalable technique that permits information learned about a fluid during small-scale testing to be applied effectively when transitioning to use of the fluid in large scale, e.g., commercial or high volume, droplet-ejection conditions. As discussed above, since the flow-path configuration in the printhead and the liquid composition are identical to the testing condition, nearly identical behavior should occur under the same operating conditions, thus reducing or even eliminating the need for additional testing to determine operating conditions for the commercial apparatus. In addition, testing can be performed using lower-cost printheads.

However, in order for the flow-path configurations in the test printhead and commercial printhead to be identical, the printheads must have a structure that is scalable and that can be reliably fabricated with high tolerance and low printhead-to-printhead variability. One implementation of such a printhead is described below.

Figure 8:
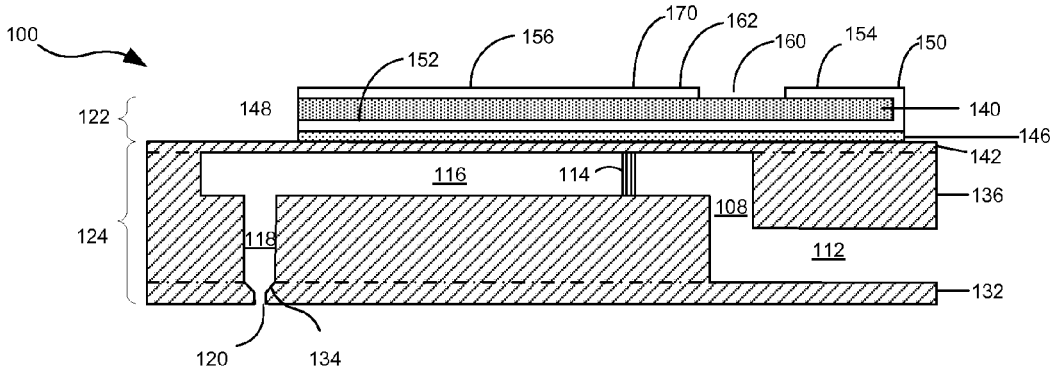
FIG. 8 is cross-sectional view of a printhead.

Referring to FIG. 8, a cross-section through a flow path of a single jetting structure in a printhead 100, ink enters the printhead 100 through a supply path 112, and is directed through an ascender 108 to an impedance feature 114 and a pumping chamber 116. Ink is pressurized in the pumping chamber by an actuator 122 and directed through a descender 118 to a nozzle opening 120 from which drops are ejected.

The flow path features are defined in a body 124. The body 124 includes a base portion, a nozzle portion and a membrane. The base portion includes a base layer of silicon (base silicon layer 136). The base portion defines features of the supply path 112, the ascender 108, the impedance feature 114, the pumping chamber 116 and the descender 118. The nozzle portion is formed of a silicon layer 132. The nozzle silicon layer 132 is fusion bonded (dashed line) to the base silicon layer 136 of the base portion and defines tapered walls 134 that direct ink from the descender 118 to the nozzle opening 120. The membrane includes a membrane silicon layer 142 that is fusion bonded to the base silicon layer 136, on a side opposite to the nozzle silicon layer 132.

The actuator 122 includes a piezoelectric layer 140. A conductive layer under the piezoelectric layer 140 can form a first electrode, such as a ground electrode 152. An upper conductive layer on the piezoelectric layer 140 can form a second electrode, such as a drive electrode 156. A wrap-around connection 150 can connect the ground electrode 152 to a ground contact 154 on an upper surface of the piezoelectric layer 140. An electrode break 160 electrically isolates the ground electrode 152 from the drive electrode 156. The metallized piezoelectric layer 140 can be bonded to the silicon membrane 142 by an adhesive layer 146. The adhesive layer can include polymerized benzocyclobutene (BCB).

The metallized piezoelectric layer 140 can be sectioned to define active piezoelectric regions, or islands, over the pumping chambers. The metallized piezoelectric layer 140 can be sectioned to provide an isolation area 148. In the isolation area 148, piezoelectric material can be removed from the region over the descender 118. This isolation area 148 can separate arrays of actuators on either side of a nozzle array.

The printhead 100 is a generally rectangular solid. In one implementation, the printhead 100 is between about 30 and 70 mm long, 4 and 12 mm wide and 400 to 1000 microns thick. The dimensions of the printhead can be varied, e.g., within a semiconductor substrate in which the flow paths are etched, as will be discussed below. For example, the width and length of the printhead may be 10 cm or more.

Figure 9:
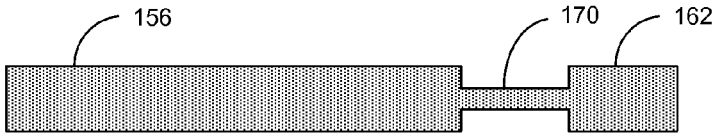
FIG. 9 is a top view of an electrode from a printhead.

Referring to FIG. 9, a top view illustrates an upper electrode 156 corresponding to a flow path. The upper electrode 156 is connected through a narrow electrode portion 170 to a drive electrode contact 162 to which an electrical connection is made for delivering drive pulses. The narrow electrode portion 170 can be located over the impedance feature 114 and can reduce current loss across a portion of the actuator 122 that need not be actuated. A flex circuit (not shown) can be secured to the back surface of the actuator 122, e.g., to the drive electrode contact 162 and the ground electrode 152, for delivering drive signals that control ink ejection.

The techniques to manufacture such a printhead is are described in U.S. Application Ser. No. 60/621,507, filed Oct. 21, 2004 (in which the printhead is referred to as a module), U.S. application Ser. No. 10/962,378, filed Oct. 8, 2004, and U.S. application Ser. No. 10/189,947, filed Jul. 3, 2002, the entire disclosures of which are incorporated by reference.

Figure 10A:
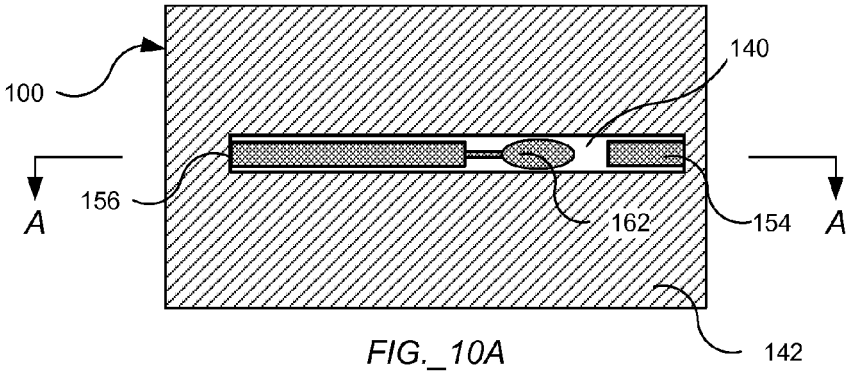
FIGS. 10A and 10B are top and bottom views of a printhead with a single flow path and a single nozzle.
Figure 10B:
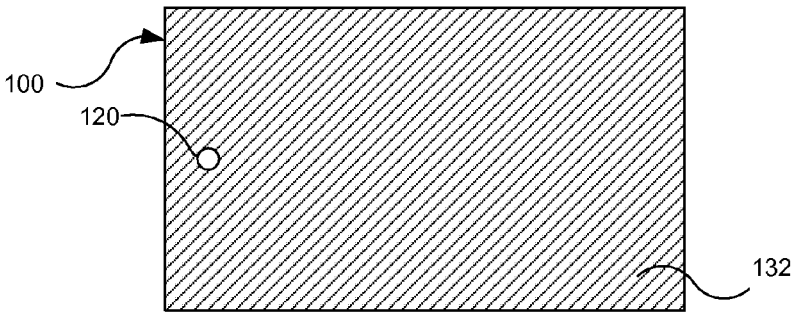
Figure 11A:
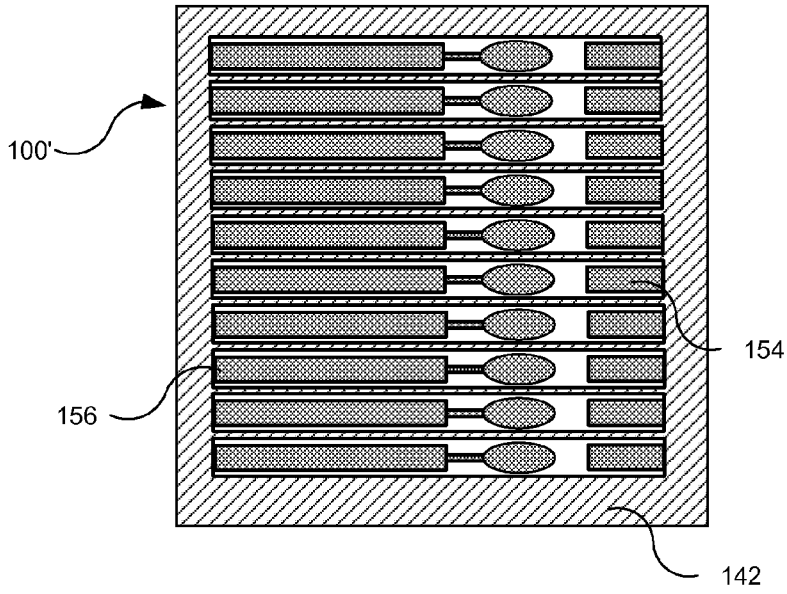
FIGS. 11A, 11B and 11C are top, bottom and perspective views of a printhead with multiple flow paths and multiple nozzles.
Figure 11B:
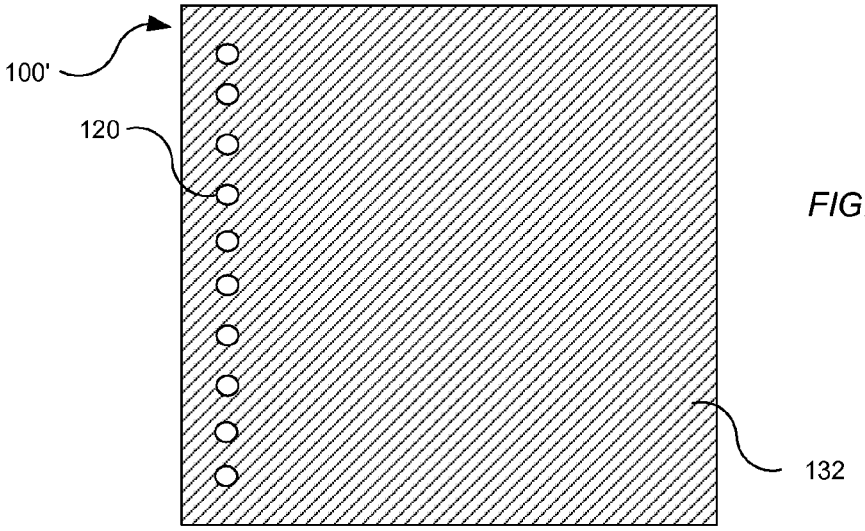
Figure 11C:
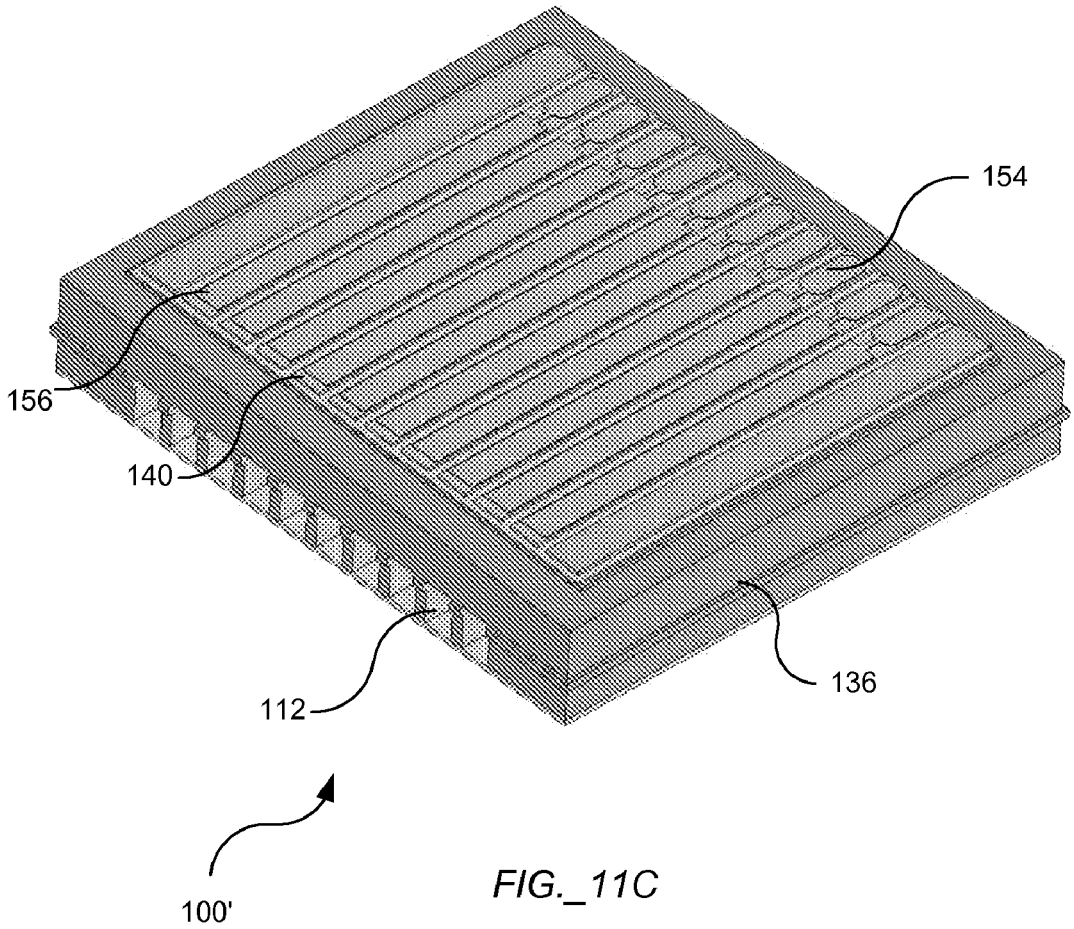
Figure 12A:
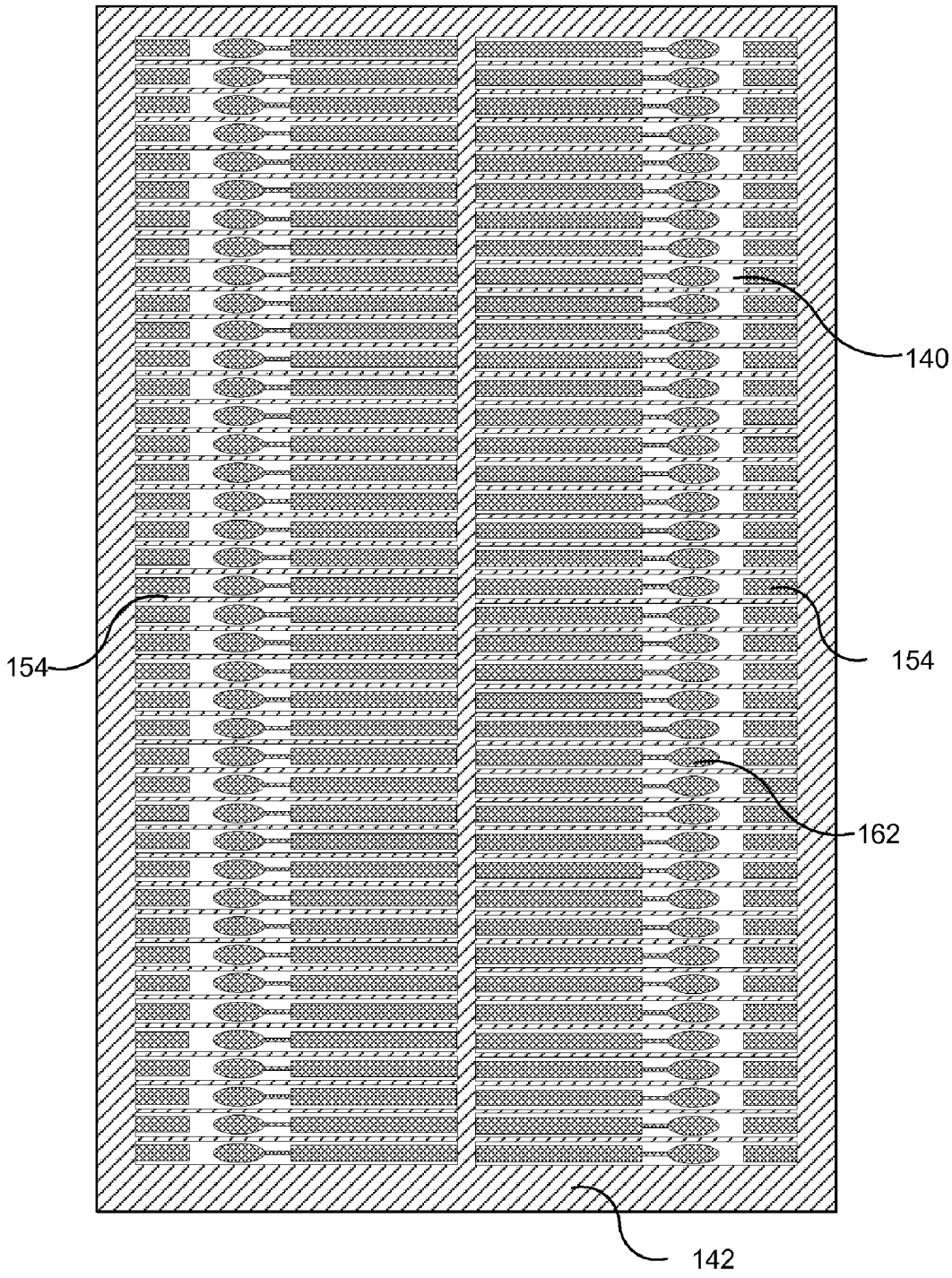
FIG. 12A is a top view of a printhead with multiple nozzles in which flow paths of alternating nozzles extend toward opposite edges of the die.
Figure 12B:
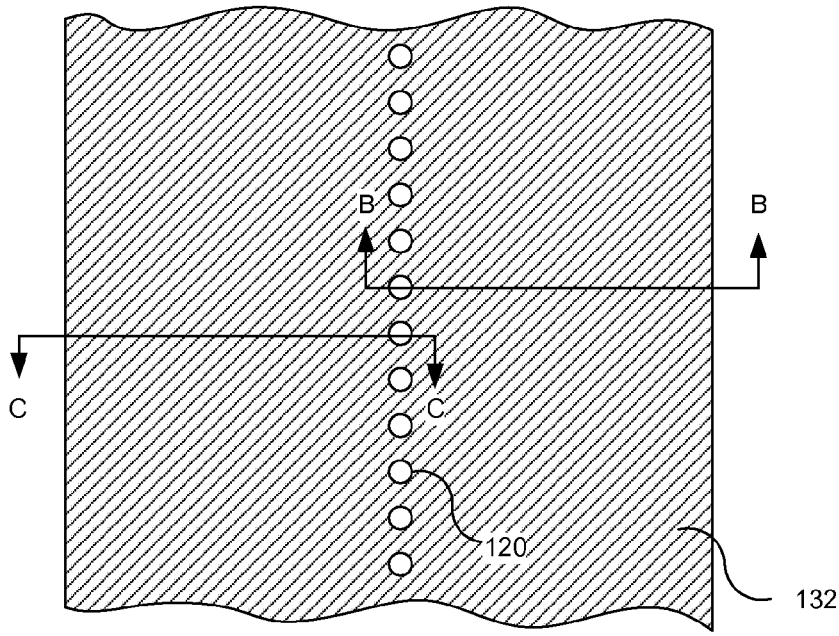
FIG. 12B is a partial bottom view of the printhead of FIG. 12A.
Figure 13:
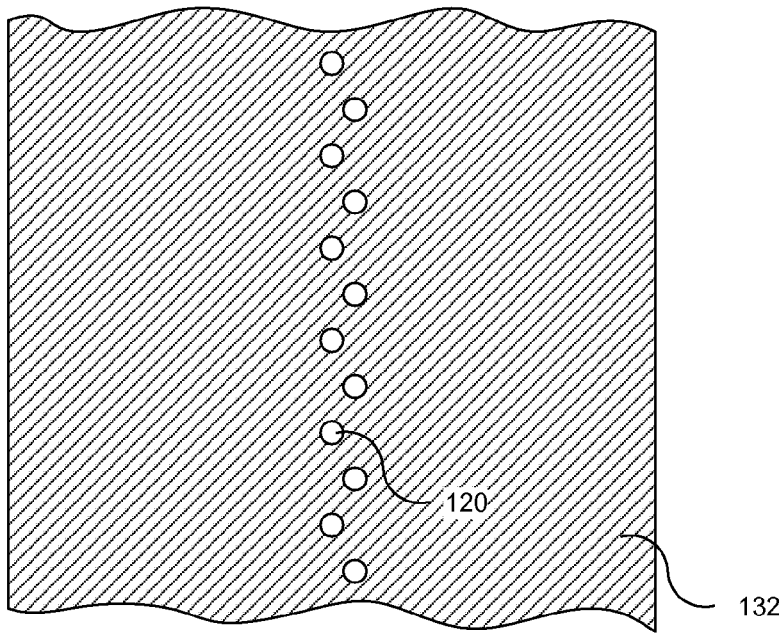
FIG. 13 is a bottom view of a printhead in which adjacent nozzle openings are slightly offset.

One advantage of this jetting structure is that it is easily scalable, i.e., different numbers of jetting structures can be fit on a die. Referring to FIGS. 10A and 10B (a cross-sectional view along line A-A in FIG. 10A should be substantially the same as FIG. 8), the printhead die 100 can have just a single droplet ejector, with single flow path leading to a single nozzle 120 and a single actuator. Alternatively, referring to FIGS. 11A-11C, the printhead die 100 can have a plurality of droplet ejectors (the implementation of FIG. 11C differs from FIGS. 11A-11B in that the inlets 112 are on the side of the die opposite the drive contacts and the ground electrodes are positioned on edges of the die). For printhead dies having a few droplet ejectors, such as two to ten, the droplet ejectors can be disposed in a single column of parallel ink flow paths and actuators. Referring to FIGS. 12A-12B, if many droplet ejectors, e.g., several hundred, such as 306 ejectors, are to be formed on a single die, the droplet ejectors can be disposed in two parallel columns, with nozzles arranged in a line near the center of the die and the flow paths of alternating nozzles extending toward opposite edges of the die (cross-sectional views along both lines B-B and C-C in FIG. 12B should both be substantially the same as FIG. 8). A description of a similar configuration can also be found in aforementioned U.S. application Ser. No. 10/189,947. Alternatively, adjacent nozzles can be slightly offset from one another as shown in FIG. 13.

A number of embodiments of the invention have been described. Nevertheless, it will be understood that various modifications may be made without departing from the spirit and scope of the invention. Accordingly, other embodiments are within the scope of the following claims.

What is claimed is:

1. A method, comprising:

ejecting liquid having a first composition from a first droplet ejection deposition system that includes a first printhead and a first fluid source, wherein the first printhead has a first number of flow paths, each flow path of the first number of flow paths including an inlet, a pumping chamber and a nozzle, and wherein the first fluid source is configured to be self-contained and to hold a first volume of liquid;

collecting information on the behavior of the liquid under a variety of ejection conditions for the first droplet ejection deposition system;

selecting ejection conditions based on the information; and ejecting liquid having the first composition from a second droplet ejection deposition system that includes a second printhead and a second fluid source under the selected ejection conditions, wherein the second printhead has a second number of substantially identical flow paths, each of the second number of flow paths being substantially identical to at least one of the first number of flow paths, wherein the second fluid source is not self-contained or is configured to hold a second volume of liquid larger than the first volume, and wherein the second number is at least ten times larger than the first number.

2. The method of claim 1, wherein the first number is at most ten.

3. The method of claim 2, wherein the first number is one.

4. The method of claim 1, wherein the second number is at least one-hundred times larger than the first number.

5. The method of claim 1, wherein selecting ejection conditions includes determining ejection conditions that are at least satisfactory for droplet ejection from the first droplet ejection deposition system or the second droplet ejection deposition system.

6. The method of claim 1, further comprising joining a fluid supply unit to a printhead unit to form a cartridge that is removably installable in the first droplet ejection deposition system, the fluid supply unit providing the first fluid source.

7. The method of claim 6, wherein the fluid supply unit and the printhead unit are substantially not detachable once joined.

8. The method of claim 1, further comprising ejecting a plurality of liquids having different compositions from the first droplet ejection deposition system.

9. The method of claim 8, further comprising testing the plurality of liquids for effectiveness in a proposed application and selecting the first composition from the different compositions based on effectiveness.

10. The method of claim 8, further comprising collecting information on the behavior of the plurality of liquids and selecting the first composition from the different compositions based on suitability for droplet ejection.

11. A method, comprising:

ejecting liquid having a first composition from a first droplet ejection deposition system that includes a first printhead and a first fluid source, wherein the first printhead has a first plurality of different flow paths, each flow path of the first plurality of flow paths including an inlet, a pumping chamber and a nozzle, and wherein the first fluid source is configured to be self-contained and to hold a first volume of liquid;

collecting information on the behavior of the liquid under a variety of ejection conditions for the first droplet ejection deposition system;

selecting ejection conditions based on the information; and ejecting liquid having the first composition from a second droplet ejection deposition system that includes a second printhead and a second fluid source under the selected ejection conditions, wherein the second printhead has a second plurality of substantially identical flow paths, each of the second plurality of flow paths being substantially identical to one of the first plurality of flow paths, wherein the second fluid source is not self-contained or is configured to hold a second volume of liquid larger than the first volume.

12. The method of claim 11, wherein there are more flow paths in the second printhead than in the first printhead.

13. The method of claim 11, wherein selecting ejection conditions includes determining ejection conditions that are at least satisfactory for droplet ejection from the first droplet ejection deposition system or the second droplet ejection deposition system.

14. The method of claim 11, further comprising designing the second printhead based on the information.

15. The method of claim 14, wherein designing the second printhead includes selecting the one of the first number of flow paths based on suitability for droplet ejection.

16. The method of claim 11, further comprising joining a fluid supply unit to a printhead unit to form a cartridge that is removably installable in the first droplet ejection deposition system, the fluid supply unit providing the first fluid source.

17. The method of claim 16, wherein the fluid supply unit and the printhead unit are substantially not detachable once joined.

18. The method of claim 11, further comprising ejecting a plurality of liquids having different compositions from the first droplet ejection deposition system.

19. The method of claim 18, further comprising testing the plurality of liquids for effectiveness in a proposed application and selecting the first composition from the different compositions based on effectiveness.

20. The method of claim 18, further comprising collecting information on the behavior of the plurality of liquids and selecting the first composition from the different compositions based on suitability for droplet ejection.

* * * * *